US008177500B2

(12) United States Patent
Bredwad et al.

(10) Patent No.: US 8,177,500 B2
(45) Date of Patent: May 15, 2012

(54) INTAKE DEVICE AND A PUMP STATION

(75) Inventors: Viktor Bredwad, Spånga (SE); Zbigniew Czarnota, Ekerö (SE)

(73) Assignee: Xylem IP Holdings LLC, White Plains, NY (US)

( * ) Notice: Subject to any disclaimer, the term of this patent is extended or adjusted under 35 U.S.C. 154(b) by 693 days.

(21) Appl. No.: 12/245,092

(22) Filed: Oct. 3, 2008

(65) Prior Publication Data

US 2010/0086400 A1 Apr. 8, 2010

(51) Int. Cl.
*F04D 29/54* (2006.01)

(52) U.S. Cl. ..... 415/208.1

(58) Field of Classification Search ..... 415/183–185, 415/191, 208.1, 208.2, 220, 222; 285/179–183, 285/222

See application file for complete search history.

(56) References Cited

U.S. PATENT DOCUMENTS 2,874,980 A * 2/1959 Browning ..... 285/189
4,363,597 A * 12/1982 Tsunoda et al. ..... 415/1
6,729,843 B1 * 5/2004 Nichtawitz et al. ..... 415/211.2

* cited by examiner

*Primary Examiner* — Ross Gushi
(74) *Attorney, Agent, or Firm* — Browdy and Neimark, PLLC

(57) ABSTRACT

In a first aspect the invention relates to an intake device (3) for creating a uniform flow of liquid entering a pump (4), which flow of liquid is free from rotation and swirls about the inlet of said pump. The inlet device (3) comprises an inlet section (11) having an orifice (14) and a decreasing cross section area seen in the direction from said orifice (14) for gradually accelerating a flow of pumped liquid, a redirection section (12) for redirecting the flow of pumped liquid from a mainly horizontal direction to a mainly vertical direction, and an outlet section (13) arranged to be connected to an inlet (6) of a pump (4). The device is characterized in that at least a part of a circumferential wall edge of said inlet section (11) extending around said orifice (14) comprises a bevel (17). In a second aspect the invention also relates to a pump station comprising such an intake device.

8 Claims, 4 Drawing Sheets

INTAKE DEVICE AND A PUMP STATION

TECHNICAL FIELD OF THE INVENTION

The present invention relates generally to the field of pumps for pumping liquid, especially propeller pumps or axial flow pumps. Further, the present invention relates specifically to the field of intake devices for such pumps. Intake devices are also known under the name draft tubes. The intake device is suitable for creating a uniform flow of liquid entering a pump, which flow of liquid is free from rotation and swirls about the inlet of said pump. The intake device comprises an inlet section having an orifice and a decreasing cross section area seen in the direction from said orifice for gradually accelerating a flow of pumped liquid, a redirection section for redirecting the flow of pumped liquid from a mainly horizontal direction to a mainly vertical direction, and an outlet section arranged to be connected to the inlet of said pump. The invention also relates to a pump station comprising such an intake device.

BACKGROUND OF THE INVENTION

A propeller pump or an axial flow pump comprises an axial inlet and an axial outlet surrounding the housing of a drive unit of the pump. In addition, the pump comprises a hydraulic unit comprising a propeller rotationally supported at an intermediate position, close to said inlet. Propeller pumps are in general vertically arranged in and located at the lower end of a discharge pipe of a pump station. Said lower end of the discharge pipe is arranged close to the bottom level of a liquid holding tank of the pump station. It is important that the flow of liquid entering the propeller pump is uniform, i.e. that the speed of the flow of liquid is uniform, or only has a small relative deviation, across the entire cross section area of the propeller pump at the level of said propeller. If the flow of liquid is not uniform, great mechanical stress will act upon the propeller and the propeller vanes.

Reference is now made to FIG. 6, which discloses an embodiment of a prior art pump station. In the shown embodiment, a pump station, generally designated 100, comprises a liquid holding tank 101, an inlet pipe 102 and three axial flow pumps 103. Seen from above the pump station 100 has an elongated rectangular shape, the three pumps 103 being located along one of the short sides of the liquid holding tank 101 and the inlet pipe 102 being located in a long side of the liquid holding tank 101 at the other end of the pump station 100. The liquid holding tank 101 may be separated in a first section known as fore bay 104 and in a second section known as pump bay 105, the latter comprising said pumps 103. When liquid enters the pump station 100, through the inlet pipe 102, the liquid is turbulent and a rotating flow of liquid 106 arises in the fore bay 104. It would be very harmful for the pumps 103 if such a rotating and turbulent flow would be present adjacent the inlet of said pumps 103, due to pressure differences. Thus, it is important that the flow of liquid entering the pump 103 is steady and uniform. One known way of creating a steady and uniform flow of liquid is to build a large fore bay 104 and a separate cell 107 for each pump 103, such that the rotating flow of liquid 106 is broken and a straight and uniform flow of liquid enters each pump 103. The cells 107 are delimited by dividing walls 108. One drawback of pump stations arranged in the described way is that they are space requiring, i.e. that the length of the pump bay 105 is three times longer than the required length of the pump bay associated with the inventive intake device. The size of the fore bay 104 may also be decreased when using the inventive intake device.

A known way of setting up a more compact pump station, regarding the required area/volume, is to use an intake device according to the preamble of claim 1. Such an intake device is arranged to be used instead of or as a complement to the abovementioned cells 107. Hereinafter, a prior art intake device is located in an opening at the bottom of a wall of the liquid holding tank. Known intake devices have good function when used in pump stations, in which the liquid is steady and the flow of liquid towards the propeller pump is directed straight into said intake device. However, in pump stations or applications in which the flow of liquid is rotating, for example, i.e. that the main flow in the liquid holding tank is directed across the wall, in which the intake device is arranged, the flow of liquid will swirl into the intake device and will not be uniform when reaching the propeller due to turbulence in the intake device. In order to solve the latter problem the intake device may be made longer, i.e. such that the flow of liquid has a longer way and time to get uniform. However, this solution entails larger costs as well as a larger pump station.

OBJECT OF THE INVENTION

The present invention aims at obviating the aforementioned disadvantages of previously known intake devices, and at providing an improved intake device. A primary object of the present invention is to provide an improved intake device of the initially defined type, which permit that the same intake device may be used in a pump station having liquid flowing straight into the inlet of the intake device, or liquid flowing across the inlet of the intake device and conventionally swirling into the intake device. It is another object of the present invention to provide a pump station, which requires less space than known pump stations comprising the same type and quantity of pumps.

SUMMARY OF THE INVENTION

According to the invention at least the primary object is attained by means of the initially defined intake device and the pump station having the features defined in the independent claims. Preferred embodiments of the present invention are further defined in the dependent claims.

According to a first aspect of the present invention, there is provided an intake device of the initially defined type, which is characterized in that at least a part of a circumferential wall edge of said inlet section extending around said orifice comprises a bevel. According to a second aspect of the present invention, there is provided a pump station according to claim 8. The pump station comprises at least one pump and one intake device according to the invention.

Thus, the present invention is based on the insight that swirls, which are present in the inlet section of the intake device, are damageable or harmful for the pump, and it is important to supply an intake device which may be used without having the knowledge of the actual flow conditions present in the pump station.

In a preferred embodiment of the present invention, the width of said bevel, in the direction across the orifice of the inlet section, is at least 1:20 of the width of the said orifice, in order to furnish the flow of liquid with a smooth redirection as it enters the inlet section of the intake device.

According to a preferred embodiment, the bevel comprises one plane surface extending at an angle of 45° in relation to the plane of propagation of the orifice of the inlet section. Thereby the intake device is easy to manufacture, at the same time as a smooth enough redirection of the flow of liquid is provided.

BRIEF DESCRIPTION OF THE DRAWINGS

A more complete understanding of the abovementioned and other features and advantages of the present invention will be apparent from the other dependent claims as well as from the following detailed description of preferred embodiments in conjunction with the appended drawings, wherein:

DETAILED DESCRIPTION OF PREFERRED EMBODIMENTS OF THE INVENTION

Figure 1:
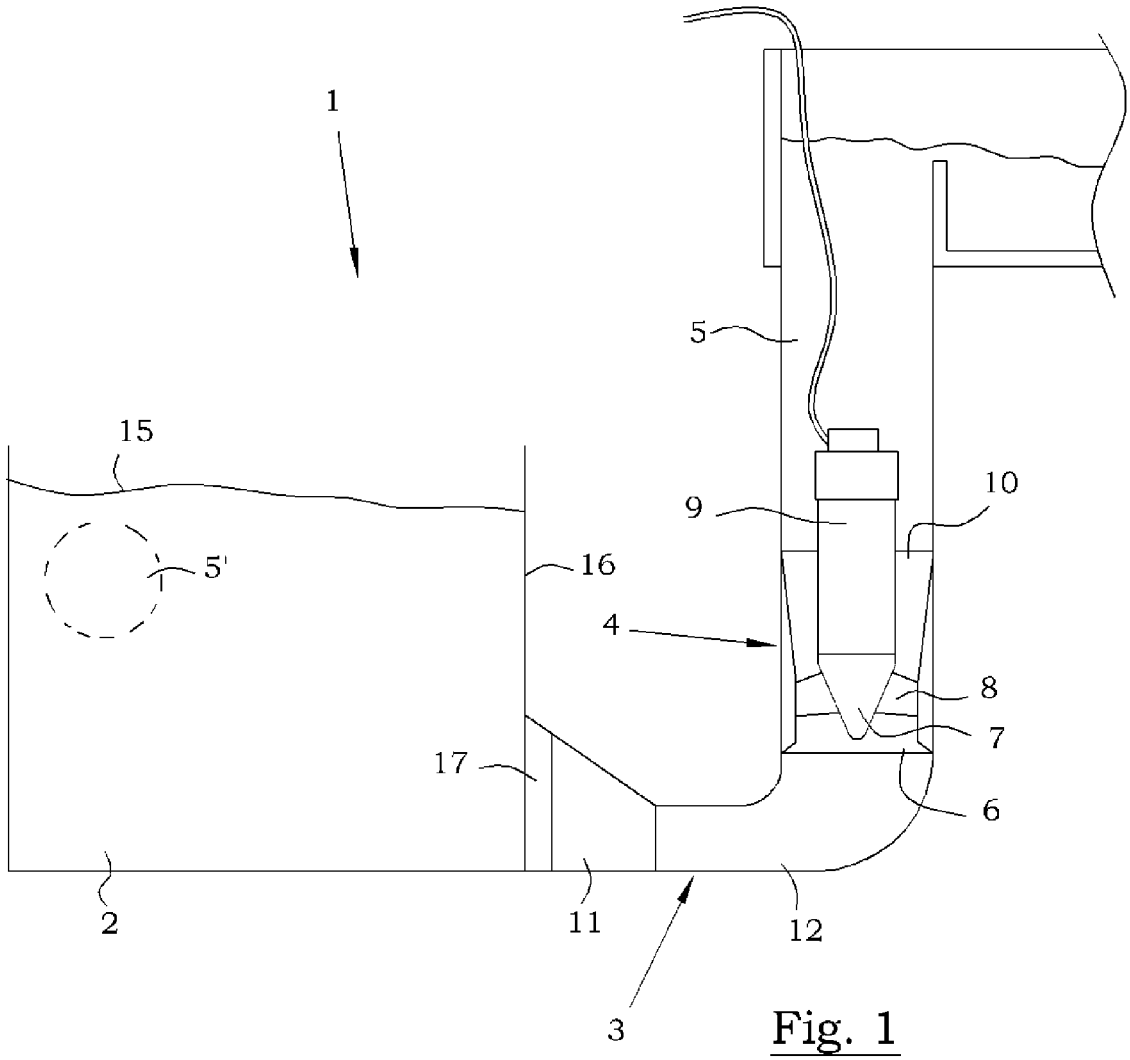
FIG. 1 is a schematic cross sectional view of a pump station comprising an inventive intake device and a propeller pump.
Figure 2:
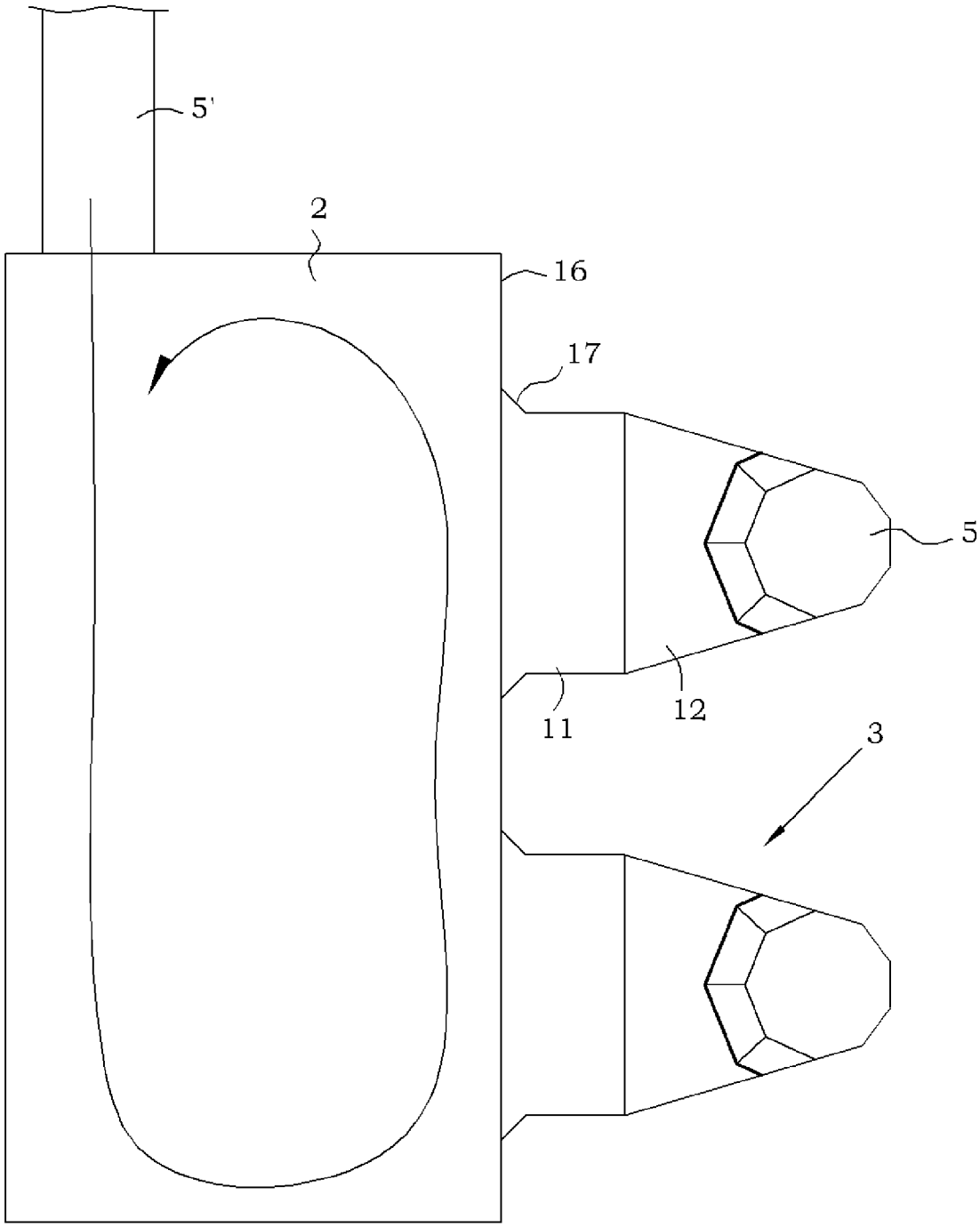
FIG. 2 is a schematic view from above of the inventive pump station according to FIG. 1.

Reference is made to FIGS. 1 and 2, in which is schematically shown an inventive pump station, generally designated 1. The pump station 1 comprises a liquid holding tank 2, also known as sump or the like, an inventive intake device, generally designated 3, also known as formed suction inlet, and a pump 4, the latter being vertically arranged in the lower end of a discharge pipe 5. The pump 4 is located adjacent the intake device 3. An inlet pipe 5' is in the shown embodiment arranged in a side wall of the liquid holding tank 2. In FIG. 2 two intake devices 3 are shown.

The pump 4 is in the preferred embodiment a propeller pump or an axial flow pump, which is schematically shown in the figure. The propeller pump 4 comprises a circular inlet opening 6, a hydraulic unit comprising a propeller comprising a nose cone 7 and a number of vanes 8, a drive unit 9 comprising a motor and a drive shaft (not shown), the latter extending from said motor to said nose cone 7 in order to rotate said propeller. In addition thereto the propeller pump 4 comprises a ring shaped outlet opening 10, surrounding the housing of said drive unit 9.

Figure 3:
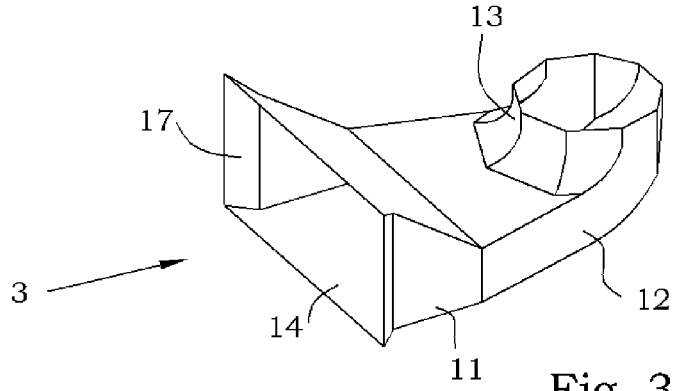
FIG. 3 is a perspective view from above of an intake device according to a first embodiment.
Figure 4:
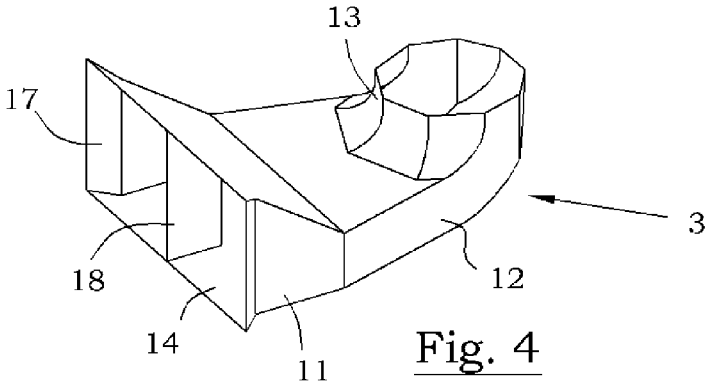
FIG. 4 is a perspective view from above of an intake device according to a second embodiment.
Figure 5:
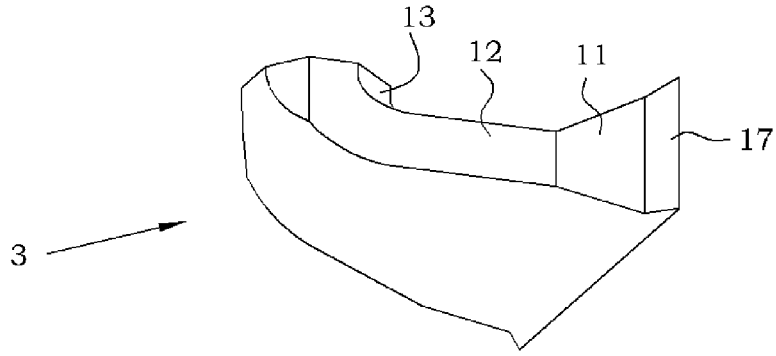
FIG. 5 is a perspective view from below of an intake device.
Figure 6:
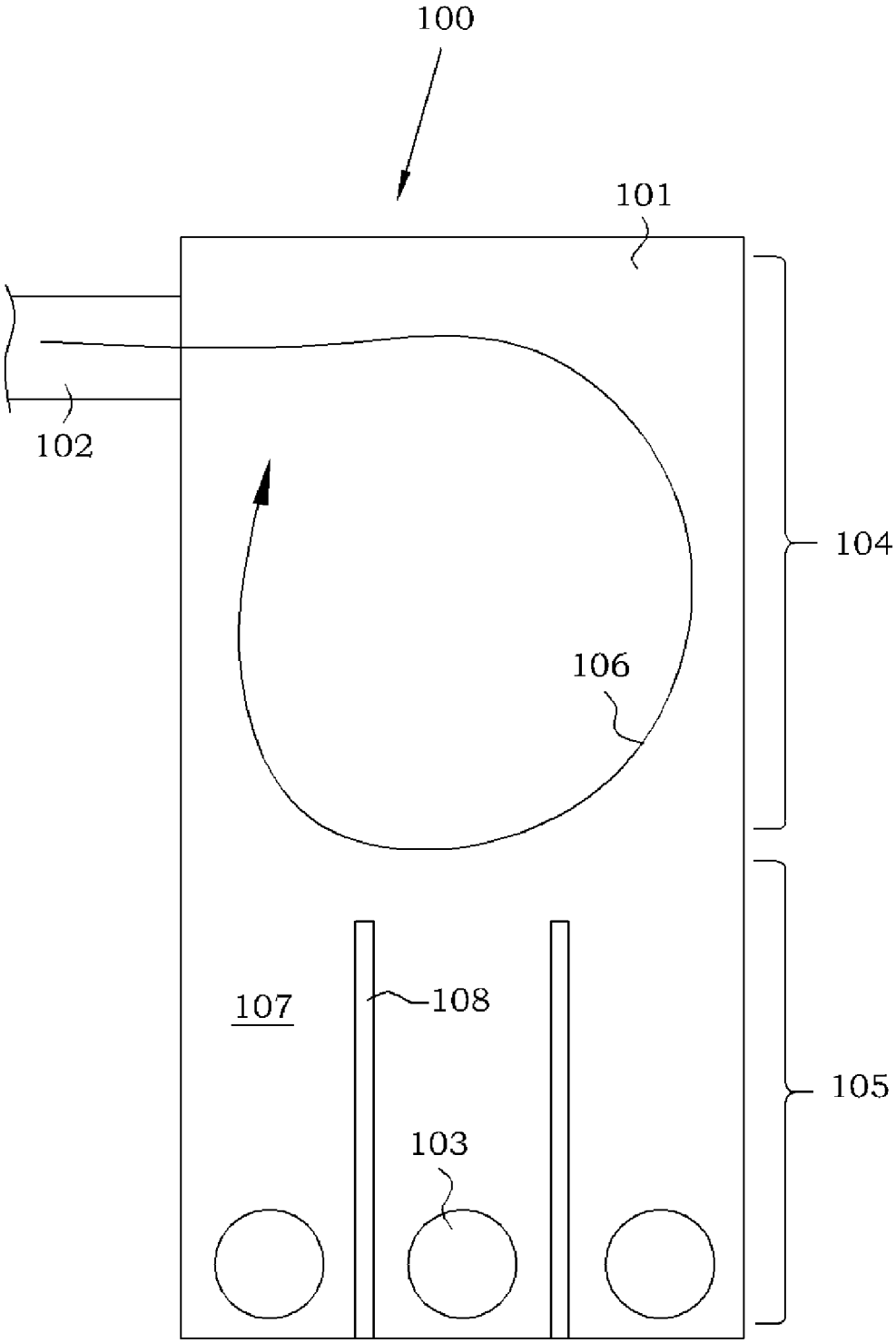
Fig. 6 Prior Art
FIG. 6 is a schematic cross sectional view of a prior art pump station.

Reference is now also made to FIGS. 2-4, i.e. to both the first as well as the second embodiment of the inventive intake device 3. The intake device 3 comprises an inlet section 11, a redirection section 12 and an outlet section 13. The inlet section 11 has a decreasing cross section area seen from an orifice 14 towards said redirection section 12. Said decreasing cross section area of the inlet section 11, has preferably an area ratio of at least 2:1 seen from the upstream part of the inlet section 11 to the downstream part of the inlet section 11. The object of the inlet section 11 is to gradually accelerate and make the flow of pumped liquid uniformed. The object of the inlet section 11 is also to obstruct rotations and swirls of liquid about or adjacent the inlet of the pump 4. The object of the redirection section 12 is to smoothly redirect the flow of pumped liquid from a mainly horizontal direction to a mainly vertical direction. The outlet section 13 of the intake device 3 is arranged to be connected to the inlet opening 6 of the pump 4 and/or to the inlet opening of the discharge pipe 5. It should be pointed out that the intake device 3 preferably is manufactured solely from plane pieces and pieces curved in only on plane, in order to reduce the manufacturing cost to a minimum.

The hydraulic unit, i.e. the nose cone 7 and the vanes 8, of a propeller pump 4, most be arranged at least a predetermined distance below the liquid level 15 in the liquid holding tank 2, in order to function properly. Therefore, the height of the redirection section 12 as well as the outlet section 13 of the intake device 3 are designed to be as low as possible, in order to get a minimum liquid level in the liquid holding tank that is as low as possible. A small lowering of the propeller pump 4 admit that the minimum liquid volume held in the liquid holding tank 2 is decreased to a great extent. In the shown preferred embodiments said height is less than twice the height of the most upstream part of the redirection section 12, i.e. measured at the interface between the sloping upper wall of the inlet section 11 and the generally horizontal upper wall of the redirection section 12.

The orifice 14 of the inlet section 11 is arranged to mouth in a side wall 16 of the liquid holding tank 2, and thereto said orifice 14 is preferably mainly vertical, and delimited by a circumferential wall edge, i.e. horizontal upper end lower wall edges and vertical side wall edges. In a preferred embodiment the orifice 14 of the inlet section 11 is rectangular. Adjacent to the orifice 14 said circumferential wall edge of the inlet section 11 extending around said orifice 14 comprises, at least in part, a bevel 17. Preferably, said bevel 17 is arranged in connection to generally vertical parts of the circumferential wall edge, i.e. preferably both of the vertical side wall edges presents a bevel 17.

Each bevel 17 may comprise a plane surface extending preferably at an angle of 45° in relation to the plane of propagation of the orifice 14 of the inlet section 11. Preferably, each bevel 17 may comprise several vertical and plane facet surfaces, or most preferably a rounded surface, in order to obtain a smooth transition between the side wall 16 of the liquid holding tank 2 and the side wall of the inlet section 11. The width of said bevel 17, in the direction across the orifice 14 of the inlet section 11, is preferably at least 1:20 of the width of the said orifice 14. The object of the bevel 17 is to smoothly redirect the flow of liquid flowing along the side wall 16 of the liquid holding tank 2 into the intake device 3. If the intake device 3 does not comprise the inventive bevel 17, swirls will originate in the inlet section 11 which leads to a not homogenized flow of pumped liquid will reach the propeller pump 4, and an uneven load will act damagingly against the vanes 8 of the propeller.

Reference is now made to FIG. 3, i.e. the second embodiment of the inventive intake device 3.

In the second embodiment of the present invention the intake device 3 comprises at least one guide vane 18 arranged in said inlet section 11 adjacent to and extending from said orifice 14, i.e. preferably positioned perpendicular to the orifice 14 of the inlet section 11. The intake device 3 may comprise two guide vanes 18 each arranged at the outer part of the orifice 14, i.e. in vicinity of the bevels 17 arranged in connection to the side wall edges of the inlet section 11. The object of the guide vane 18 is to further homogenize the flow of pumped liquid.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the intake device as well as the pump station may be modified in all kinds of ways within the scope of the appended claims.

It should be pointed out that the intake device preferably is constructed as disclosed in the drawings, however, the intake device may as well be constructed as a cavity in a concrete block, for example, which cavity has the same features as the disclosed intake device.

It shall also be pointed out that all information about/concerning terms such as above, below, under, upper, horizontal, vertical, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations thereof such as "comprises" or "comprising", will be understood to imply the inclusion of a stated integer or steps or group of integers or steps but not the exclusion of any other integer or step or group of integers or steps.

The invention claimed is:

1. An intake device (3) for creating a homogenous flow of liquid entering a pump (4), comprising an inlet section (11) having an orifice (14) and a decreasing cross section area seen in the direction from said orifice (14) for accelerating a flow of pumped liquid, the orifice (14) being disposed mainly vertically, a redirection section (12) for redirecting the flow of pumped liquid from a mainly horizontal direction to a mainly vertical direction, and an outlet section (13) arranged to be connected to an inlet (6) of a pump (4), wherein at least a part of a circumferential wall edge of said inlet section (11) extending around said orifice (14) comprises a bevel (17), the bevel (17) comprising a plane surface, and the bevel (17) being arranged in connection with generally vertical parts of the circumferential wall edge of the inlet section (11) extending around the orifice (14).

2. The intake device (3) according to claim 1, wherein said bevel (17) comprises several plane facet surfaces.

3. The intake device (3) according to claim 1, wherein the intake device (3) comprises at least one guide vane (18) arranged in said inlet section (11) adjacent to said orifice (14), and positioned perpendicular to the orifice (14) of the inlet section (11).

4. A pump station (1) comprising at least one pump (4) and at least one intake device (3) connected to an inlet (6) of said pump (4), characterized in, that said intake device (3) is an intake device (3) according to claim 1.

5. The intake device (3) according to claim 1, wherein the width of said bevel (17), in the direction across the orifice (14) of the inlet section (11), is at least 1:20 of the width of the said orifice (14).

6. The intake device (3) according to claim 5, wherein the intake device (3) comprises at least one guide vane (18) arranged in said inlet section (11) adjacent to said orifice (14), and positioned perpendicular to the orifice (14) of the inlet section (11).

7. A pump station (1) comprising at least one pump (4) and at least one intake device (3) connected to an inlet (6) of said pump (4), wherein said intake device (3) is an intake device (3) according to claim 6.

8. A pump station comprising at least one pump (4) and at least one intake device (3) connected to an inlet (6) of said pump (4), wherein the intake device (3) comprises means for accelerating a flow of pumped liquid comprising an inlet section (11) having an orifice (14) and a decreasing cross section area seen in the direction from said orifice (14)

a redirection section (12) for redirecting the flow of pumped liquid from a mainly horizontal direction to a mainly vertical direction, and an outlet section (13) connected to an inlet (6) of said pump (4), wherein at least a part of a circumferential wall edge of said inlet section (11) extending around said orifice (14) comprises a plane surface bevel (17), and wherein means for effecting a smooth redirection of liquid comprises the plane surface bevel (17) at said inlet section (11) extending at a 45° angle in relation to the orifice (14) of the inlet section (11).

* * * * *